United States Patent [19]

Barnes et al.

[11] Patent Number: 4,728,028

[45] Date of Patent: Mar. 1, 1988

[54] DELIVERY SIGNAL DEVICE FOR A MAILBOX

[76] Inventors: Randy G. Barnes; Eukal U. Gardner, both of R.R. 1, Ava, Mo. 65608

[21] Appl. No.: 45,090

[22] Filed: May 4, 1987

[51] Int. Cl.[4] ..... B65D 91/00

[52] U.S. Cl. ..... 232/35; 232/17

[58] Field of Search ..... 232/35, 34, 17

[56] References Cited

U.S. PATENT DOCUMENTS

| | | | |
|---|---|---|---|
| 3,426,966 | 2/1969 | Lay | 232/35 |
| 3,482,543 | 12/1969 | Guidos | 232/35 |
| 3,516,383 | 6/1970 | Goodman | 232/35 X |
| 3,596,631 | 8/1971 | Sutton | 232/35 |
| 3,958,752 | 5/1976 | Piezchala | 232/35 |
| 4,073,430 | 2/1978 | Joris | 232/35 |
| 4,596,357 | 6/1986 | File | 232/35 |

*Primary Examiner*—Robert W. Gibson, Jr.

*Attorney, Agent, or Firm*—Senniger, Powers, Leavitt and Roedel

[57] ABSTRACT

A delivery signal for a mailbox comprising a bracket extending from the back of the mailbox and a signal flag mounted on the bracket and biased to a signal position. A cord attached to the signal flag extends through the bracket and toward the front of the door of the mailbox. An end member is attached to the cord. A plate having a lip releasably secures the free end of the cord, holding the flag out of the signal position, and releasing the cord when the door is opened allowing the signal flag to move under the bias to the signal position.

16 Claims, 3 Drawing Figures

DELIVERY SIGNAL DEVICE FOR A MAILBOX

BACKGROUND OF THE INVENTION

This invention relates to a delivery signal device for a mailbox, and in particular to a resettable signal device that signals that the door has been opened to indicate mail delivery.

There are a number of prior delivery signal devices for mailboxes, examples of which are disclosed in the following U.S. patents: Pieszchala, U.S. Pat. No. 3,958,752; Hunt, U.S. Pat. No. 4,065,050; Joris, U.S. Pat. No. 4,073,430; File U.S. Pat. No. 4,205,778, and Schluter, U.S. Pat. No. 4,449,663. Many of these prior devices were of complicated construction, and thus were expensive and subject to failure. Several of these prior devices were not adapted to be readily retrofit to existing mailboxes. Some of these prior devices relied upon mechanisms inside the mailbox, which could be interfered with or damaged by the insertion of mail into the box. Some of these prior devices were difficult to reset, and thus difficult to use.

SUMMARY OF THE INVENTION

Among the objects of the present invention is the provision of a delivery signal device for a mailbox which is of simple construction for low cost and highly reliable operation; the provision of such a device that can be easily incorporated into new mailboxes and that can be easily retrofit to existing mailboxes; the provision of such a device that has no parts inside the mailbox that could be interfered with or damaged by the insertion of mail into the box; and the provision of such a device that can be quickly and easily reset.

The signal device of the present invention is adapted for use on a mailbox of the type having a bottom, a top, opposing sides, a back, and a door pivotally mounted to the box near the bottom and closing the front. Generally, the signal device comprises a bracket which extends from the back of the mailbox and includes a guide means, a signal flag, and means for mounting the signal flag on the bracket forward of the guide means. The mounting means includes means for resiliently biasing the signal flag to a signal position. A cord is attached to one end to the signal flag, and extends through the guide means in the bracket, and forward under the bottom of the mailbox toward the door. A releasable securing means is positioned on the exterior of the door for releasably securing the end of the cord to hold the signal flag out of the signal position, the releasable securing means releasing the cord as the door is opened, allowing the signal flag to move to the signal position.

According to the present invention, the signal device can also be provided in kit form to facilitate retrofitting the signal device to an existing mailbox. Generally, the kit of the present invention comprises a bracket, including a guide means, and means for attaching the bracket to the back of the mailbox, a signal flag, and means for mounting the signal flag on the bracket forward of the guide means. The mounting means includes means for resiliently biasing the signal flag to a signal position. The kit further includes a cord that is adapted to be attached to one end to the signal flag, extended through the guide means in the bracket, and extended forward under the bottom of the mailbox toward the door. Finally the kit includes means for releasably securing the end of the cord, and means for attaching the securing means to the exterior of the door in position that the cord holds the signal flag out of the signal position, the securing means releasing the cord as the door is opened to allow the signal flag to move to the signal position. An end member is preferably attached to the cord and the securing means is preferably a plate having a lip that slopes downwardly and outwardly, forming a concave seat to receive the end member.

Other objects and features will be in part apparent and in part pointed out hereinafter.

BRIEF DESCRIPTION OF THE DRAWINGS

Corresponsing reference characters indicate corresponding parts throughout the several views of the drawings.

DETAILED DESCRIPTION OF THE PREFERRED EMBODIMENT

Figures 1, 2, 3:
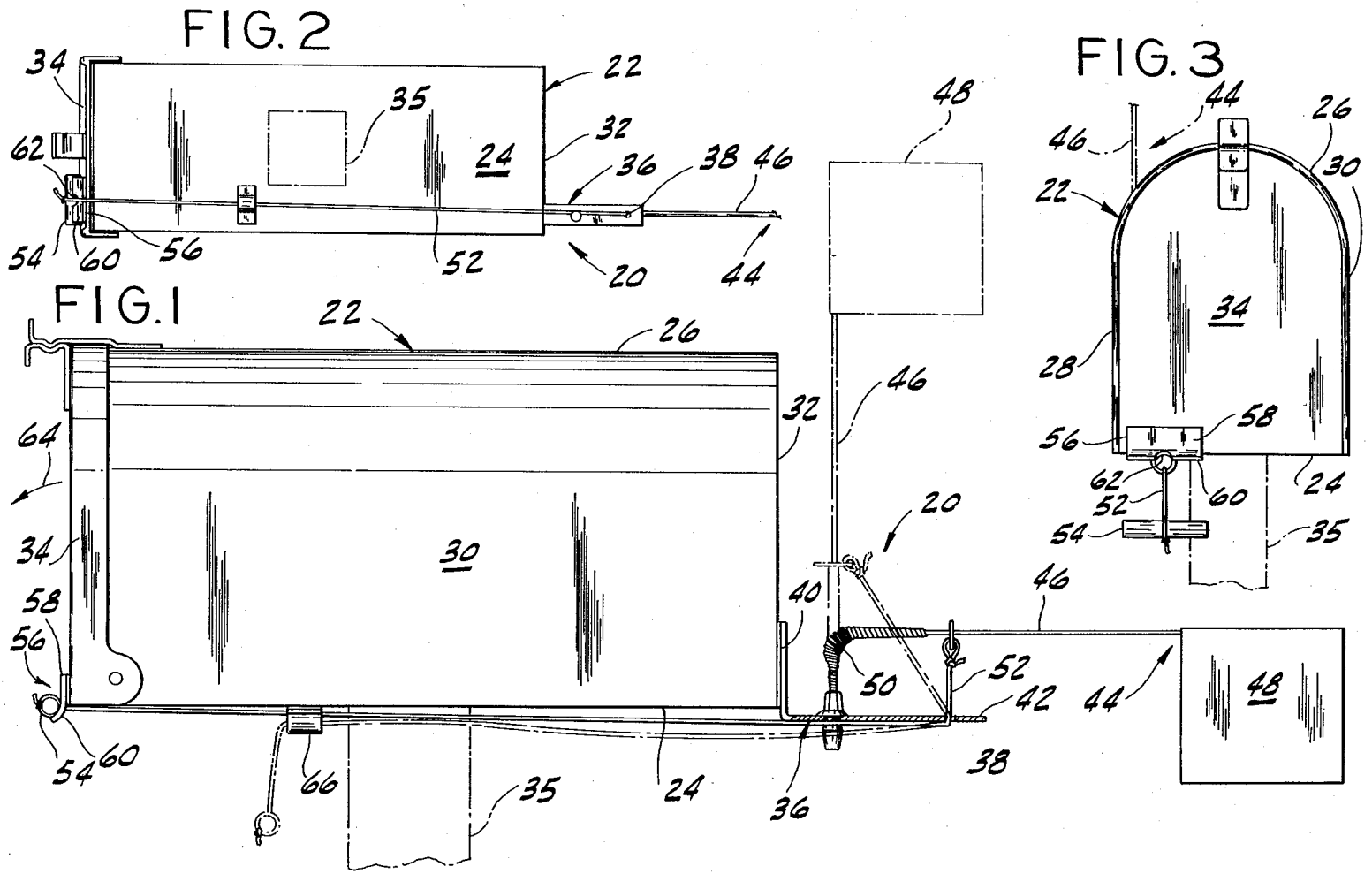
FIG. 1 is a side elevation view of a mailbox incorporating the signaling device of the present inventon, showing the signal flag retracted but showing the signal flag in the signal position in phantom.
FIG. 2 is a bottom plan view of the mailbox.
FIG. 3 is a front end elevation view of the mailbox, with the signal flag in the signal position.

The signal device of the present invention, indicated generally as 20 in the figures, is shown as it would be mounted on a mailbox 22. Mailbox 22 is a typical rural mailbox, comprising a bottom 24, a curved top 26, opposing sides 28 and 30, a back 32, and a door 34 pivotally mounted to the mailbox near the bottom and closing the front. As is well known, the door 34 may be pivotally connected at the sides as shown, hingedly connected along the bottom edge, or otherwise connected to mail box 22. The mailbox 22 is typically mounted on a post 35, shown in phantom in the figures. As described throughout this application the term mailbox is used to mean a mailbox, newspaper box, or any other similar device.

The signal device comprises a bracket 36 extending from the back of the mailbox. The bracket 36 includes a guide means, such as guide hole 38. In the preferred embodiment, bracket 36 is generally L-shaped, having first leg 40 and second leg 42, the first leg being attached to the back 32 of the mailbox so that the second leg extends generally rearwardly therefrom.

A signal flag 44 is mounted on the bracket 36 forward of the guide hole 38. The signal flag 44 comprises a staff 46 and a flag member 48. although some other construction could be used. The signal flag is resiliently biased to a signal position, shown in phantom FIG. 1. In the preferred embodiment the signal flag 44 is mounted on the bracket 36 with a coil spring 50, preferably one having a bulbous middle section. The staff 46 of the flag 44 is received in the top of the spring 50.

A cord 52 is attached at one end to the signal flag 44, and extends through the guide hole 38 in the bracket 36, and forward below the bottom of the mailbox toward the door. The free end of the cord has an end member 54 attached thereto. In the preferred embodiment the end member 54 is generally cylindrical, and the cord is attached thereto generally at the center of the cylinder.

A plate 56 is attached to the exterior of the door, near the bottom edge. The plate 56 releasably secures the end member 54, securing the end of the cord in position that the cord holds the signal flag 44 out of the signal position. The plate 56 releases the cord as the door is opened allowing the signal flag to move to the signal position. In the preferred embodiment the plate 56 comprises flat portion 58 and a downwardly forwardly sloping lip 60 forming a concave seat for receiving the end member 54. The plate 56 is preferably positioned on the exterior of the door to allow the lip 60 to extend below the bottom of the door as shown in FIG. 1. As shown in FIGS. 2 and 3, lip 60 has a generally v-shaped notch 62 therein for receiving the cord.

When the door 35 is in the closed position, end member 54 can be secured in the concave seat formed by lip 60. As the door pivots open as indicated by arrow 64 in FIG. 1, the lip 60 pivots from its sloped orientation to vertical. As the lip pivots past vertical, the end member 54 is freed from the lip 60, releasing the cord 22 and allowing the signal flag 44 to return to the signal position under the bias of spring 50.

A guide loop 66 may be provided on the bottom of the mailbox. The guide loop is sized to allow the cord 52 to freely pass therethrough but to engage the end member 54, thus the guide 66 loop acts to trap the end of the cord in position where it can be easily grasped to reset the signal device, as shown in FIG. 1.

As noted above, according to the present invention the signal device can be provided in kit form to facilitate retrofitting the signal device to existing mailboxes. Such a kit includes the generally L-shaped bracket 36 having the guide hole 38 on one of the legs and means for attaching the bracket to the back of the mailbox on the other of the legs. This attaching means is preferably adhesive (not shown) on the leg which is covered with a removable protective cover that can be removed to expose the adhesive and attach the bracket to the back of the mailbox with one of the legs of the "L" extending generally rearwardly. A signal flag 44 is mounted on the leg of the bracket forward of the guide hole. As described above, signal flag 44 is resiliently biased to a signal postion. A cord is provided and is adapted to be attached at one end to the signal flag, extended through the guide means in the bracket, and extended forward under the bottom of the mailbox toward the door. The cord has an end member 54 on the free end. Finally, the kit includes a plate 56 for releasably seucring the end member of the cord. Plate 56 comprises a flat portion 58 and a lip 60 that forms a concave seat for receiving the end member. The flat portion 58 includes means for attaching the plate 56 to the exterior of the door in position to secure the cord to hold the signal flag 44 out of the signal position. This attaching means is preferably adhesive (not shown) which is covered with a removable protective cover that can be removed to expose the adhesive and attach the plate 56 to the exterior of the door, with the lip 60 extending below the bottom edge. The plate 56 releases the cord when the door is opened to allow the signal flag to move to the signal position. The kit can also include a guide loop 66 having means for attaching the loop to the bottom 24 of the mailbox. This attaching means is preferably adhesive (not shown) which is covered with a removable protective cover that can be removed to expose the adhesive and secure the guide loop 66 to the bottom of the mailbox.

Operation

The kit of the present invention is used by removing the protective cover from the adhesive on the leg of the L-shaped bracket 36 and attaching the bracket to the back of the mailbox, preferably to one side and near the bottom. The plate 56 is then attached to the exterior of the door by removing the protective cover from the adhesive and attaching the plate to the door in position that the lip 60 extends below the bottom edge of the door. The cord is then attached to the signal flag 44, passed through the guide hole 38, and extended forwardly toward the door. Cylindrical end member 54 is attached to the free end of the cord. In an original installation, some other method of attaching the bracket and the plate such as a more permanent adhesive, may be used.

In operation, the end member 54 is pulled to pull the signal flag 44 from the signal position. The end member can then be secured in the concave seat formed by the lip 60, with the v-shaped notch 62 receiving the cord 52. The end member is held by the lip 60 until the door is opened. As the door is opened, the lip 60 pivots toward vertical. As the lip passes vertical, the end member 54 is freed from the lip 60, releasing the cord and allowing the signal flag to move under the bias of spring 50 to the signal position. Where a guide loop 66 is employed, the guide loop holds the cord 52 and end member 54 after release in convenient position where it can be grasped to reset the signal device.

In view of the above, it will be seen that the several objects of the invention are achieved and other advantageous results attained.

As various changes could be made in the above constructions without departing from the scope of the invention, it is intended that all matter contained in the above description of shown in the accompanying drawings shall be interpreted as illustrative and not in a limiting sense.

We claim:

1. In combination with a mailbox having a bottom, a top, opposing sides, a back, and a door pivotally mounted to the box near the bottom and closing the front, a resettable signal for indicating that the door has been opened, the signal comprising:

a bracket extending from the back of the mailbox, the bracket including a guide means;

a signal flag;

means for mounting the signal flag on the bracket forward of the guide means, the mounting means including means for resiliently biasing the signal flag to a signal position;

a cord attached at one end to the signal flag, extending through the guide means in the bracket and forward under the bottom of the mailbox toward the door;

means on the exterior of the door for releasably securing the end of the cord thereto whereby the cord holds the signal flag out of the signal position, the securing means releasing the cord when the door is opened thereby allowing the signal flag to move to the signal position.

2. The combination according the claim 1 further comprising an end member on the end of the cord, and wherein the securing means comprises a downwardly, forwardly sloping lip for engaging the end member, the lip having a notch therein for receiving the cord.

3. The combination according to claim 2 wherein the securing means is positioned on the exterior of the door near the bottom, with the lip extending below the bottom edge of the door.

4. The combination according to claim 2 wherein the end member is generally cylindrical, and wherein the cord is attached to the cylindrical end member at about its center.

5. The combination according to claim 2 further comprising a guide loop on the bottom of the mailbox through which the cord passes, the guide loop being sized to engage the end member on the cord.

6. A kit for installing a resettable signal on a mailbox having a bottom, a top, opposing sides, a back, and a door pivotally mounted near the bottom and closing the front, the resettable signal indicating that the door has been opened, the kit comprising:

a bracket, the bracket including a guide means;

means for attaching the bracket to the back of the mailbox;

a signal flag;

means for mounting the signal flag on the bracket forward of the guide means, the mounting means including means for resiliently biasing the signal flag to a signal position;

a cord adapted to be attached at one end to the signal flag, extended through the guide means in the bracket, and extended forward under the bottom of the mailbox toward the door;

means for releasably securing the then free end of the cord; and, means for attaching the securing means to the exterior of the door in position that the securing means secures the cord to hold the signal flag out of the signal position, the securing means releasing the cord when the door is opened to allow the signal flag to move to the signal position.

7. The kit according to claim 6 further comprising an end member on the free end of the cord, and wherein the releasable securing means comprises a plate having a downwardly, forwardly sloping lip for securing the end member, the lip having a slit therein for receiving the cord.

8. The kit according to claim 7 wherein the end member is generally cylindrical, and wherein the cord is attached to the cylindrical end member at about its center.

9. The kit according to claim 7 wherein the means for attaching the securing means comprises an adhesive on the back of the plate which is covered with a removable protective cover which can be removed to expose the adhesive and secure the a plate to the front of the door.

10. The kit according to claim 7 further comprising a guide loop and means for attaching the guide loop on the bottom of the mailbox, the guide loop sized to allow the cord to slide freely therethrough but to engage the end member.

11. The kit according to claim 10 wherein the means for attaching the guide loop comprises an adhesive on the guide loop which is covered with a removable protective cover that can be removed to expos the adhesive and attach the guide loop to the bottom of the mailbox.

12. The kit according to claim 6 wherein the bracket is generally L-shaped, and wherein the attaching means comprises an adhesive on one of the legs of the L that is covered with a removable protective cover that can be removed to expose the adhesive and attach the bracket to the back of the mailbox with the other of the legs of the L extending generally rearwardly.

13. The kit according to claim 6 wherein the means for mounting the signal flag to the bracket comprises a coil spring.

14. The kit according to claim 6 wherein the signal flag comprises a shaft and a flag member attached to the upper end of the shaft.

15. The kit according to claim 6 wherein the guide means is a hole in the bracket for receiving the cord.

16. A resettable signal for a mailbox having a bottom, a top, opposing sides, a back, and a door pivotally mounted near the bottom and closing the front, the signal indicating that the door has been opened, the signal comprising:

a generally L-shaped bracket, having first and second legs, the first leg being attached to the back of the mailbox so that the second leg extends generally rearwardly therefrom, the second leg having a guide passage therein;

a signal flag;

means for mounting the signal flag on the bracket forward of the guide passage, the mounting means including means for resiliently biasing the signal flag to a signal position;

a cord attached at one end to the signal flag, extending through the guide passage in the bracket, and forward under the bottom of the mailbox toward the door;

an end member on the free end of the cord;

a plate on the exterior of the door near the bottom, the plate having a downwardly, forwardly sloping lip extending below the bottom of the door for engaging the end member, the lip having a notch therein for receiving the cord, the lip releasably securing the end member into the door whereby the cord holds the signal flag out of the signal position, the lip releasing the cord when the door is opened allowing the signal flag to move to the signal position.

* * * * *